US007506392B2

(12) United States Patent
Croxton

(10) Patent No.: US 7,506,392 B2
(45) Date of Patent: Mar. 24, 2009

(54) LAUNDRY MACHINE CONTROL SYSTEM FOR LOAD IMBALANCE DETECTION AND EXTRACTION SPEED SELECTION

(75) Inventor: Timothy Dean Croxton, Omro, WI (US)

(73) Assignee: Alliance Laundry Systems LLC, Ripon, MI (US)

( * ) Notice: Subject to any disclaimer, the term of this patent is extended or adjusted under 35 U.S.C. 154(b) by 225 days.

(21) Appl. No.: 11/472,054

(22) Filed: Jun. 21, 2006

(65) Prior Publication Data

US 2007/0294838 A1 Dec. 27, 2007

(51) Int. Cl.
*D06F 33/02* (2006.01)

(52) U.S. Cl. ..... 8/158; 68/12.06; 68/12.23; 68/23.1

(58) Field of Classification Search ..... 8/158, 8/159; 68/12.06, 12.01, 12.23, 23.1, 24
See application file for complete search history.

(56) References Cited

U.S. PATENT DOCUMENTS 6,418,581 B1 7/2002 Bruce et al.
6,564,592 B2 5/2003 Bruce et al.
2004/0156170 A1 * 8/2004 Mager et al. ..... 361/683

* cited by examiner

*Primary Examiner*—Joseph L Perrin
(74) *Attorney, Agent, or Firm*—Leydig, Voit & Mayer, Ltd.

(57) ABSTRACT

A control system for a laundry washing machine with a horizontal wash drum detects load imbalance in the drum and selects a proper rotation speed for the drum in a water extraction operation. A drive controller for the motor turning the drum detects a phase angle variation in the drive voltage and drive current applied to the motor as an indication of the load imbalance in the drum, and determines whether the detected load imbalance falls in one of a plurality of pre-defined load-imbalance zones. The drive controller then provides a signal indicating the detected imbalance zone to a machine controller of the washing machine. The machine controller selects a proper rotation speed for the extraction operation based on the detected imbalance zone, or alternatively initiates a load-redistribution operation to reduce the load imbalance.

18 Claims, 6 Drawing Sheets

LAUNDRY MACHINE CONTROL SYSTEM FOR LOAD IMBALANCE DETECTION AND EXTRACTION SPEED SELECTION

FIELD OF THE INVENTION

The invention generally relates to laundry machines, and more particularly to a control system for a washer/extractor-type laundry machine for setting a proper extraction rotation speed for an extraction operation.

BACKGROUND OF THE INVENTION

Many commercial laundry machines are designed to handle a heavy load of clothing to be cleaned. Due to the large capacities of the machines, special attention has to be given to the structural strength and operational controls of the machines to ensure their proper and safe operations.

In particular, load balancing is an important concern for front-loading washer/extractor-type laundry machine (hereinafter referred to as "washer"). A washer typically has a wash drum for receiving a laundry load, and in a front-loading washer the drum is mounted to rotate around a generally horizontal axis. After the washing and rinsing cycles are done, water is extracted from the clothing by spinning the drum at a relatively high speed. For a commercial washer with a large load capacity, such as one that is rated for 150 pounds of dry clothing, the mass of the wet clothing can be quite large. To effectively remove the water from the clothing, the rotational speed of the drum during the water extraction phase can be quite high, and can generate a centrifugal force of 300 G or higher. Because the drum is horizontally mounted, there is a tendency for the clothing to sit at the lower portion of the drum before the extraction rotation begins, resulting in an imbalance in the load distribution in the drum. Due to the heavy load in the wash drum and the high rotation speed for water extraction, if the wet laundry load is not evenly distributed in the rotating drum, the imbalance can cause significant vibrations of the drum that may result in severe mechanical stress and even structural damages to the machine.

SUMMARY OF THE INVENTION

In view of the foregoing, it is an object of the invention to provide an effective way to handle the possible imbalance of the wet load in the drum of a washer to avoid severe mechanical stress or damages to the laundry machine.

To that end, it is a related object to provide a control system for a washer with a horizontally rotating drum that can effectively determine the degree of load imbalance in the drum and select a proper rotation speed for the drum for the extraction operation.

It is a further related object of the invention to provide a control mechanism for the control system that is simple to implement yet effective in communicating the degree of detected imbalance and setting the proper extraction speed for the drum.

These objects and other related objects are achieved by the present invention, which provides a control system for analyzing the load imbalance in the rotating drum of a washer/extractor type laundry machine, and setting an optimal rotation speed of the drum to ensure proper water extraction without exceeding the structural limit of the machine. In accordance with the invention, prior to a high-rotation-speed extraction operation, the drum with the laundry load therein is first rotated at a relatively low speed, such as 60 rpm, in a load imbalance detection phase. A drive controller for the motor that rotates the drum monitors the variation of a phase angle between the voltage and current applied to the motor. Based on the detected phase angle variation amplitude, the drive controller characterizes the detected load imbalance as being in one of a plurality of pre-defined load imbalance zones. The drive controller than sends a signal to the machine controller of the washer to indicate the load imbalance zone for the detected load imbalance. Based on the detected load imbalance zone as indicated by the signal sent by the drive controller, the machine controller may select a rotation speed for the extraction that is at or below a pre-defined top rotation speed associated with the detected load imbalance zone. The machine controller may also initiate a load redistribution operation if the detected load imbalance too high to allow effective extraction.

The advantages of the invention can be understood from the description of embodiments of the invention set forth below with reference to the drawings, in which:

BRIEF DESCRIPTION OF THE DRAWING(S)

DETAILED DESCRIPTION OF THE INVENTION

Figure 1:
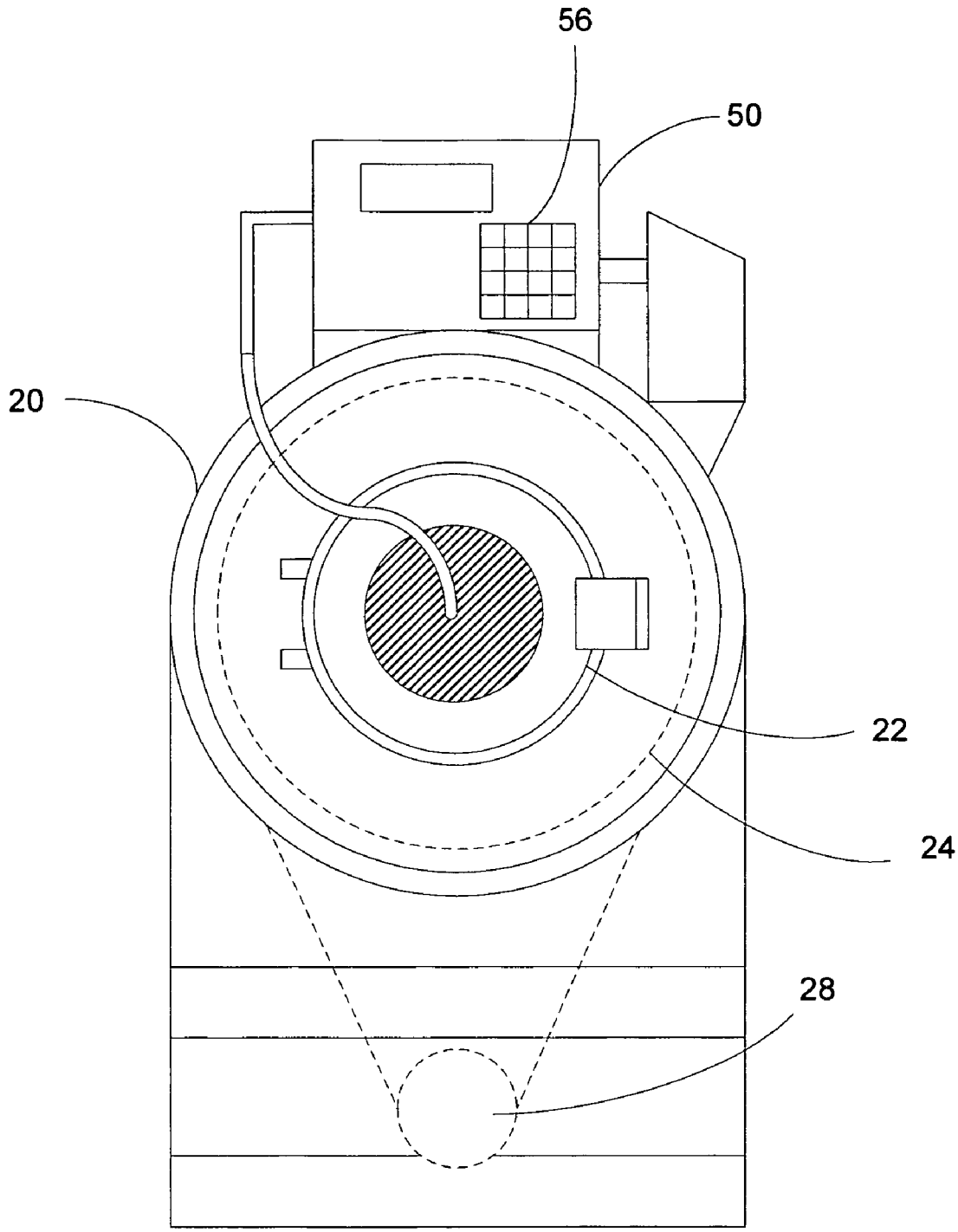
FIG. 1 is a partially schematic front view of a washer/extractor-type laundry machine with a wash drum therein that rotates about a generally horizontal axis.

FIG. 1 shows a laundry machine 20 that incorporates an embodiment of the control system for load imbalance detection and spin speed control in accordance with the invention. In the embodiment shown in FIG. 1, the laundry machine 20 is of the front-loading washer-extractor type, with a front door 22 that can be opened for loading clothing to be cleaned into the machine. The laundry machine has a wash drum 24 into which the clothing is loaded. The drum 24 is supported in the washer-extractor for rotation about a generally horizontal central axis. During the washing and rinsing phases of the cleaning operation, the drum 24 is partially filled with water (or other solvent used for cleaning) and is rotated at relatively low speeds to tumble the clothing to enhance the cleaning effects. After the washing and rinsing phases are completed, the drum with the wet clothing therein is rotated at a relatively high angular velocity to remove water from the wet clothing by means of centrifugal force. To effectively extract water from the clothing, the rotation speed of the drum can be quite high, and can generate a centrifugal force as high as, for example, 300 G.

Figure 2:
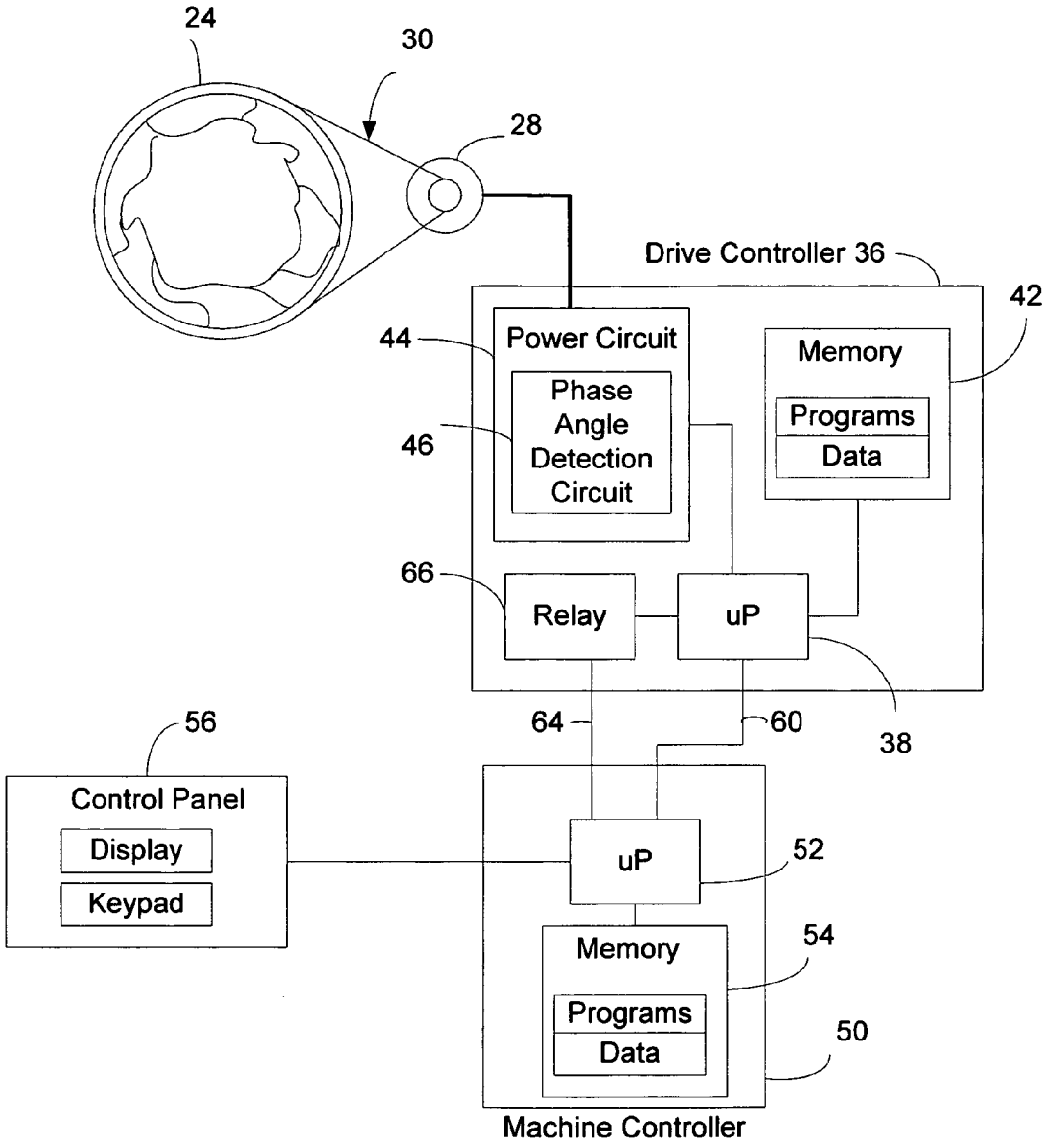
FIG. 2 is a schematic view showing the laundry machine in the form of functional blocks.

As shown in FIG. 2, the drum 24 is driven by a motor 28, which is coupled to the drum 24 via suitable means such as belt/pulley arrangement 30 or gears. The motor 28 may be, for example, an AC motor that provides a torque sufficient for driving the drum with wet clothing therein to desired rotational speeds. The motor 28 is powered by a drive controller 36, which provides the needed voltage and current for energizing the motor. In one embodiment, the drive controller 36 includes a microprocessor 38 that is suitably programmed for controlling the powering of the motor 28, and a non-volatile memory 42 for storing programs and control data for the microprocessor. The non-volatile memory 42 may be read-only, and the programs stored in such a non-volatile memory are commonly referred to as "firmware". The drive controller 36 further includes a power circuit 44 that provides the current and voltage for the motor 28 under the control of the microprocessor 38. As described in greater detail below, the power circuit includes a detection circuit 46 for sensing a phase angle difference between the voltage and current applied to the motor 28.

To control its general operations, the washing machine 20 includes a machine controller 50. The machine controller 50 sends control signals to various components of the washing machine, including the drive controller 36, for carrying out a selected washing operation, which may include multiple washing, rinsing, and extraction phases. The machine controller 50 includes a control panel 56 that can be used by a user to entering operation instructions and parameter. The machine controller 50 includes a microprocessor 52 and a non-volatile memory 54 for storing program software and operation data. In a preferred embodiment, the memory 54 storing the software programs for the microprocessor is read-only.

To control the operations of the machine and to receive operational information, the machine controller is interfaced with active components of the washing machine by means of proper communication and power connections. As shown in FIG. 2, the machine controller 50 is connected to drive controller 36 for the motor 28 driving the wash drum by means a communication line 60, which may be used by the machine controller 50 to send control signals or instructions to the drive controller 36. The machine controller 50 is further connected to the drive controller 36 by a signal line 64 for receiving data from the drive controller 36. The signal line 64 connects the machine controller 50 to a signaling device in the drive controller circuit. In one embodiment, the signaling device is a relay 66, which may be a mechanical relay or a transistor-based solid-state device. As described in greater detail below, the relay 66 is operated by the drive controller 36 to provide a digital signal that indicates the magnitude of a detected imbalance of the laundry load in the drum.

Figure 3:
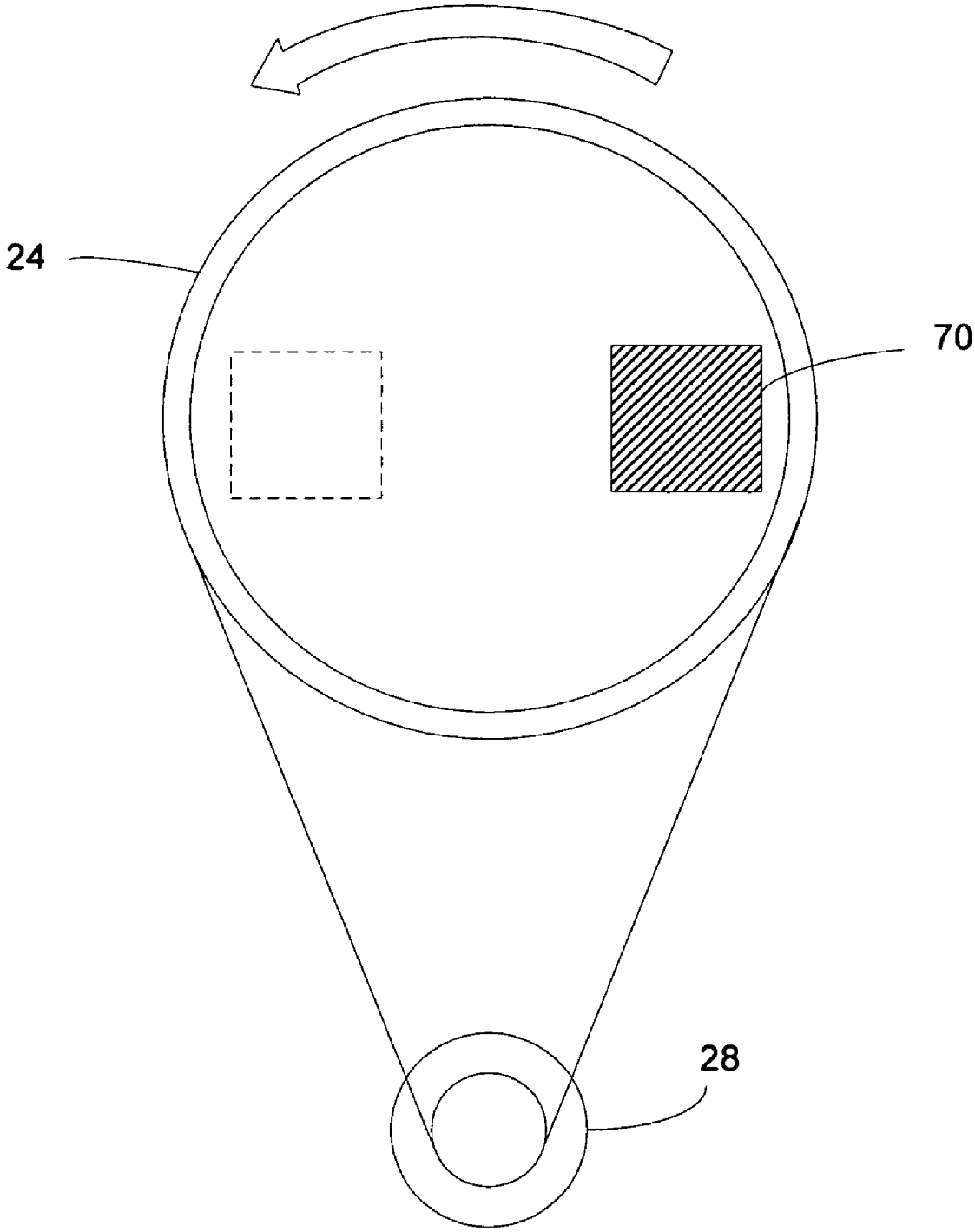
FIG. 3 is a schematic diagram showing the rotating drum with an unbalanced laundry load therein.

Turning now to FIG. 3, to determine the load imbalance in the drum 24 prior to a water extraction operation, the drive controller 36 detects the phase angle between the current and voltage applied to the motor 28 to rotate the drum 24, and the magnitude of the time-dependent variation of the phase angle provides an indication of the load imbalance in the drum. This operation of load imbalance sensing is carried out at a relatively low rotational speed of the drum 24 that is sufficiently high to prevent tumbling of the clothing in the drum to avoid redistribution of the clothing in this detection phase, but significantly lower than the rotational speed normally chosen for the extraction operation. By way of the example, the rotation or rotation speed for load imbalance detection may be set, depending on the physical size of the drum 24, to achieve a centrifugal force of 2.0 g-2.5 g. In the load imbalance detection operation, the drum 24 is driven by the motor 28 to reach a pre-selected average speed. Even though the rotation speed of the drum 24 with the wet clothing is stabilized around the constant average speed, it has a sinusoidal variation due to the existence of load imbalance in the drum, and the size of the speed variation depends on the magnitude of the load imbalance. The cause of the speed variation is illustrated in FIG. 3. For simplicity of illustration, the load imbalance is schematically depicted as a block 70 of mass. In the example shown in FIG. 4, the drum 24 is rotated counterclockwise. When the load imbalance 70 in the drum is at the 3 o'clock position, the gravitational force on the load imbalance counteracts the torque exerted by the motor 28 on the drum, causing the drum to slow down. In contrast, when the load imbalance 70 is at the 9 o'clock position, the gravitational force is in the same direction as the torque applied by the motor 28, causing the drum to rotate faster than the average speed. As a result, the rotational speed is modulated by the load imbalance as a function of the angular location of the load imbalance as it is carried by the drum in the rotational motion.

Figure 4:
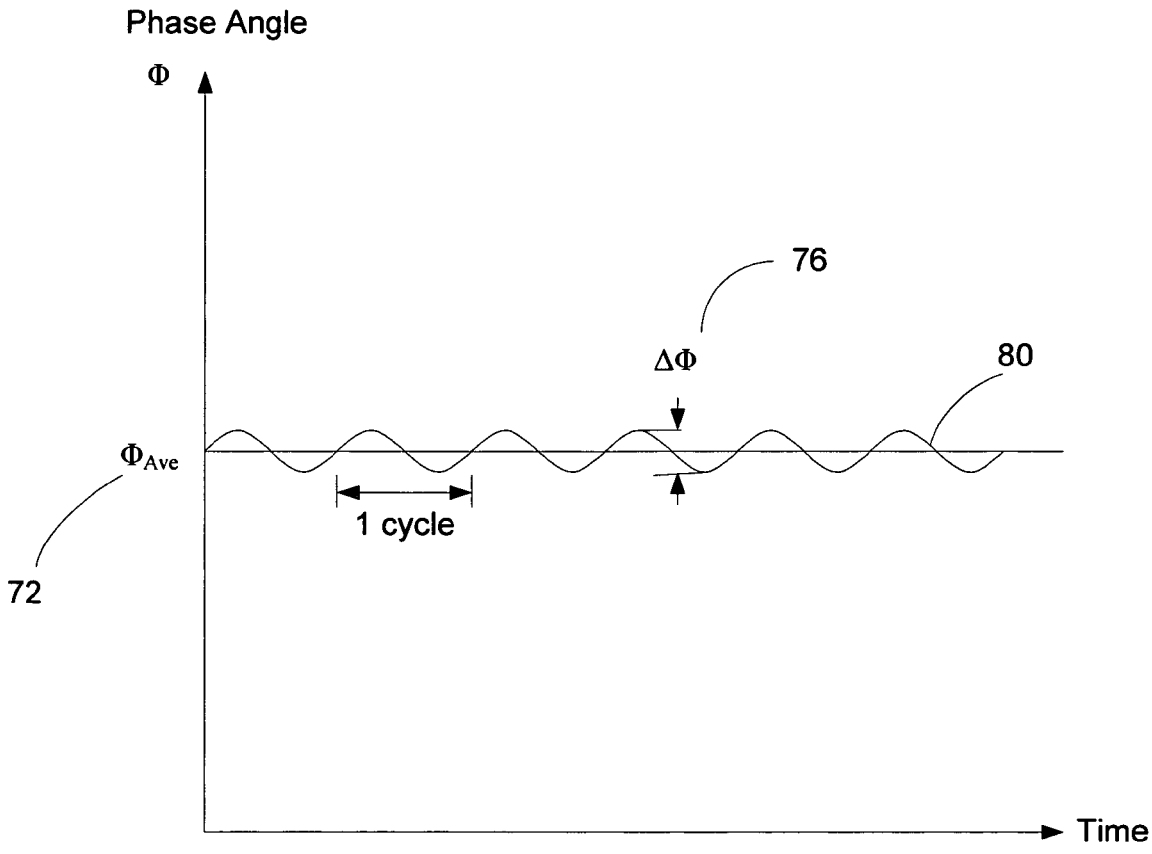
FIG. 4 is a chart showing time-dependent variations of a phase angle between the voltage and current applied to a motor that drives the rotation of the wash drum.

The variation of the rotational speed caused by the load imbalance is also reflected in the phase angle between the voltage and current applied to the drive by the drive controller. As shown in FIG. 4, a phase angle 76 exists between the voltage and current applied to the motor. When the rotational speed of the drum and the wet clothing therein is stabilized around the imbalance detection speed, the current-voltage phase angle 76 oscillates around an average angle value 80. The oscillation amplitude of the phase angle correlates to the magnitude of the load imbalance in the drum.

In accordance with a feature of the invention, the amplitude 82 of the phase angle variation is used by the drive controller 36 to assess the magnitude of load imbalance in the drum. To that end, the drive controller 36 includes a detection circuitry 46 for sensing the phase angle between the current and voltage applied to the drive during the imbalance detection phase. The detected phase angle variation is analyzed by the microprocessor 38 to determine the amplitude of the phase angle variation. The drive controller 36 then provides a signal to indicate to the machine controller 50 the degree of load imbalance in the drum as indicated by the magnitude of phase angle variation. In a preferred embodiment, measurements of the phase angle are taken when the load imbalance is at about the 3 o'clock and 9 o'clock positions, where the load imbalance has the strongest effect on the phase angle, to ensure an accurate assessment of the magnitude of the load imbalance in the wash drum.

Figure 5:
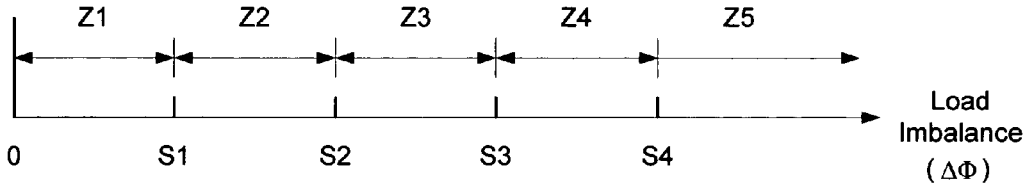
FIG. 5 is a chart showing five load imbalance zones used in an embodiment for characterizing a detected load imbalance.

In a preferred embodiment, for simplicity of communication and control, the drive controller 36 characterizes the detected load imbalance as being in one of a plurality of pre-defined load imbalance zones, each of which corresponds to a range of phase angle variation amplitude. The number of imbalance zones can be selected based on a balance between the desired precision of the load imbalance indication and the simplicity of operation control, but preferably more than three load imbalance zones are used. As illustrated in FIG. 5, in one implementation, there are five imbalance zones Z1-Z5 separated by four zone threshold values T1-T4. The five imbalance zones Z1-Z5 have pre-selected extraction speeds S1-S5 associated therewith respectively. The threshold levels T1-T4 dividing the five imbalance zones and the extraction speeds S1-S5 are stored in the memory 42 of the drive controller 36. To characterize the detected load imbalance, the drive controller 36 retrieves the zone threshold level values T1-T4 from the memory 42 and compares the detected amplitude of the current-voltage phase angle variation with the zone threshold levels to see which zone the detected imbalance falls in. The drive controller 36 then signals the machine controller 50 to indicate the imbalance zone that corresponds to the detected imbalance.

In one embodiment, the signal for indicating the load imbalance is generated using the relay 66 in the circuitry of the drive controller 36. The relay 66 is operated to close and open such that its ON/OFF state as a function of time is indicative of the detected load imbalance zone. By way of example, if the phase angle variation amplitude is equal to or less than the first zone threshold level T1, the load imbalance is in the first zone Z1. In that case, the contact of the on-board relay 66 is closed all the time, i.e., with an ON/OFF frequency of zero. If the phase angle variation amplitude is greater than the threshold level T1 but less than the threshold level T2, the detected imbalance falls in the second zone Z2. To indicate the imbalance zone Z2, the on-board relay 66 is closed and opened (or "pulsed") at a rate of 1 Hz. If the phase angle variation amplitude is greater than the zone 2 threshold level T2 but less or equal to the zone 3 threshold level T3, the detected imbalance is in the third zone Z3, which is indicated by pulsing the on-board relay 66 at a rate of 2 Hz. If the phase angle variation amplitude is greater than the zone 3 threshold level T3 but less or equal to the zone 4 level T4, the on-board relay 66 is pulsed at a rate of 3 Hz to indicate that the imbalance is in the fourth zone Z4. If the phase angle variation amplitude is greater than the zone 4 threshold level T4, the imbalance is in the fifth zone Z5, which is the zone of the highest degree of imbalance. In that case, the on-board relay contact remains open.

The machine controller 50 receives the load-imbalance signal provided by the drive controller 36 and makes a decision as to the proper drum rotation speed that should be used for the water extraction operation with the detected load imbalance. To that end, in an embodiment, the machine controller 50 has firmware in the memory 54 that is programmed to recognize the time-dependent ON/OFF state of the relay 66 to determine the imbalance zone in which the detected load imbalance falls. Once the severity of the load imbalance as indicated by the imbalance zone signal is known, the machine controller 50 can select the proper drum rotation speed to be used for the extraction operation. As mentioned above, each of the five imbalance zones Z1-Z5 has a pre-selected extraction speed limit associated therewith. The machine controller 50, however, is not bound to use the particular extraction speed limit associated with the indicated imbalance zone as the extraction rotation speed, but can pick a lower rotation speed, such as one of the lower extraction speed limits associated with the other imbalance zones.

For instance, in the example with five imbalance zones Z1-Z5, the extraction speed SI is the maximum operational speed of the drum 24 and is associated with the imbalance zone Z1 that has the lowest degree of load imbalance, while the extraction speeds S2, S3, S4 and S5 have decreasing values selected in accordance with the magnitude of load imbalance associated with their respective imbalance zones. If the detected imbalance is in zone 1, the machine controller 50 may use any of the five preset extraction speeds, instead of being required to use the maximum speed S1. If the detected imbalance is in zone 2, the machine controller may choose one speed from S2, S3, S4, and S5. If the detected imbalance is in zone 3, the machine controller may choose one speed from S3, S4, and S5. If the detected imbalance is in zone 4, the machine controller may choose one speed from S4, and S5. If the detected imbalance is in zone 5, the machine controller may set the extraction speed to the value of S5, which is the lowest of the pre-set extraction speeds.

Alternatively, depending on the extraction needs, instead of choosing from a set of pre-defined extraction speeds based on the detected imbalance zone, the machine controller 50 may initiate a redistribution operation to redistribute the load in the drum 24 to have a better load balance. In the redistribution operation, the drum 24 is rotated at a low speed such that the centrifugal force on the clothing is less than 1 G. This allows the clothing to tumble and mix in the drum 24 to achieve a more even distribution. After the redistribution operation, the machine controller 50 repeats the imbalance sensing operation, and receives a new imbalance zone signal from the drive controller 36. The machine controller 50 may then set the drum rotation speed for water extraction based on that signal, or repeat the redistribution operation if necessary. Once the extraction speed is set, the machine controller 50 sends signals through the command line 60 to communicate to the drive controller 36 the selected extraction speed. The drive controller 36 then operates the motor 28 to rotate the drum 24 at the selected speed to carries out the extraction operation.

The imbalance detection and extraction rotation speed control as described above provides advantages over conventional methods of balance detection and speed control. First, the communication of the detected load imbalance from the drive controller 36 to the machine controller 50 enables the machine controller to select a proper drum spin speed for the laundry load. The machine controller 50 can be programmed to compare the desired rotation speed for the type of laundry load with the highest allowed spin speed for the detected imbalance zone, and make an intelligent decision on whether it is necessary to attempt a redistribution of the laundry load in the drum. Also, custom firmware for the drive controller 36 and machine controller 50 may be used to allow the machine controller to remain in control of the extraction speed so that it does not exceed a desired speed for the particular laundry load, even when the detected imbalance zone permits a higher extraction speed. In other words, the machine controller 50 is not required to automatically choose the highest spin speed allowed by the detected imbalance as the actual spin speed, which may be too high for the garments in the laundry load or may adversely affect other laundry processes. Since the machine controller 50, rather than the drive controller 36, is in control of setting the extraction speed, it has the flexibility of displaying on the control panel 56 the desired extraction speed together with the actual extraction speed upon initiating the extraction step, allowing the user to intervene if necessary. Moreover, with the imbalance zone information provided by the drive controller 36, the machine controller 50 can select a proper extraction speed before the extraction operation begins, instead of having to rely on the use of vibration sensors mounted in the machine to detect excess vibrations during the actual extraction operation. Another significant advantage is that digital signals are a more cost effective way of communication than the analog signals used in conventional imbalance control systems.

Figure 6:
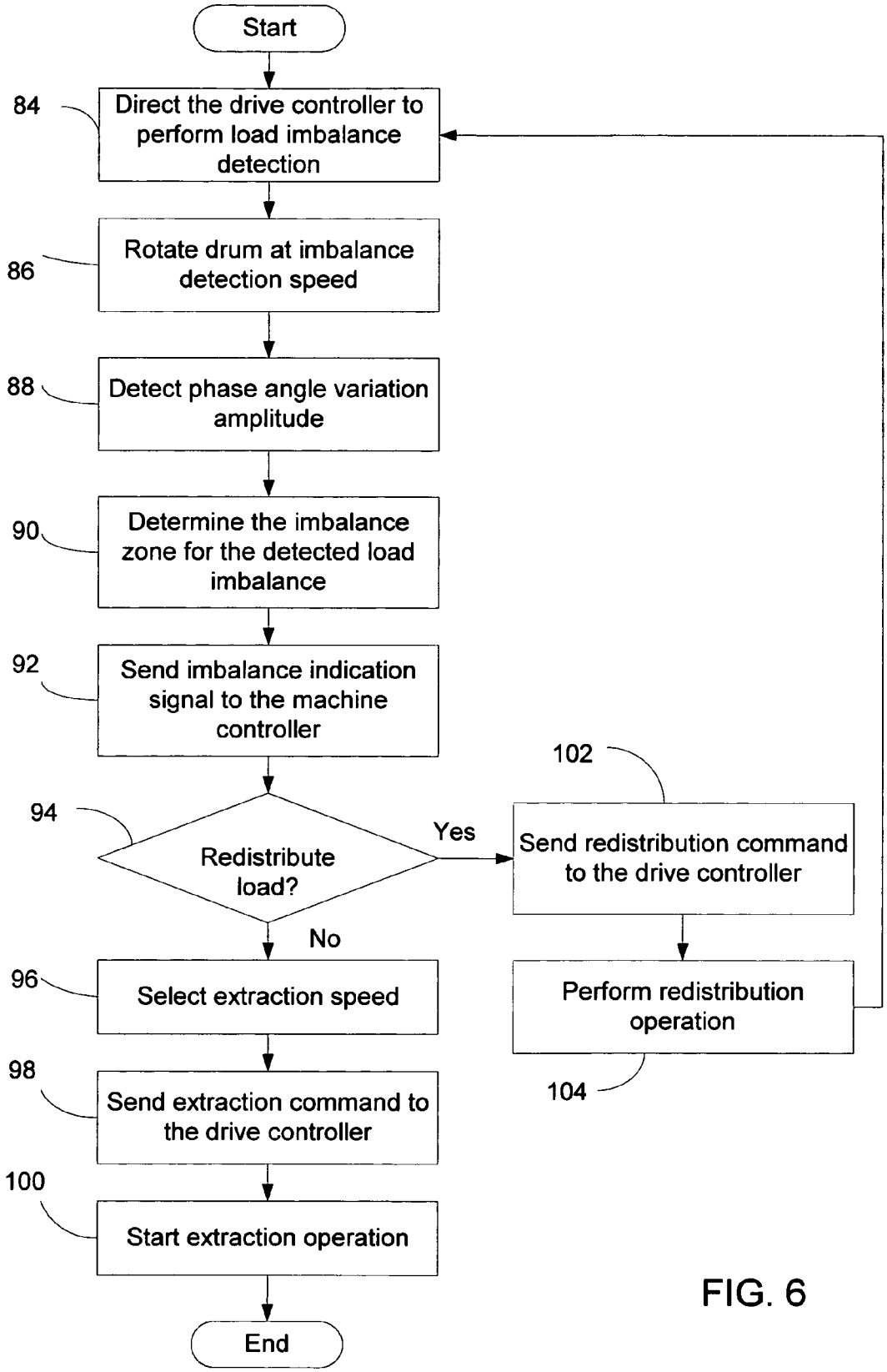
FIG. 6 is a flowchart showing a process of detecting a load imbalance in the drum and setting a rotation speed for the drum in an extraction operation.

The process of detecting load imbalance and setting the extraction speed for the drum according to the detected load imbalance is summarized in the flowchart in FIG. 6. Prior to the extraction operation, the machine controller directs the drive controller to enter a load imbalance detection phase (step 84). In response, the drive controller operates the motor to drive the drum with the wet load therein to the predefined imbalance detection speed (step 86), which is normally significantly lower than the extraction speed. After the drum speed stabilizes around the imbalance detection speed, the drive controller monitors the phase angle between the current and voltage applied to the motor, and determines the amplitude of the phase angle variation (step 88). The drive controller than determines, based on the imbalance zone thresholds stored in its memory, the imbalance zone that corresponds to the detected load imbalance as indicated by the phase angle variation amplitude (step 90). The drive controller then operates the relay to send the imbalance indication signal to the machine controller (step 92).

Based on the received signal, the machine controller determines whether it should initiate a load redistribution operation (step 94). If there is no need for load redistribution, the machine controller selects an extraction speed (step 96), which does not exceed, but may be lower than, the speed limit associated with the detected imbalance zone. The machine controller sends a command to the drive controller (step 98), along with the selected extraction speed, to the drive controller. The drive controller then controls the motor to rotate the drum to the selected extraction speed to extract water from the load step 100). If, on the other hand, the machine controller decides that it is necessary to redistribute the load in the drum to obtain a better balance, it sends a command to the drive controller to start a load redistribution operation (step 102). In response, the drive controller rotates the drum at a redistribution speed to tumble the laundry load in the drum to more evenly distribute the load in the drum (step 104). After the redistribution operation, the machine controller again directs the drive controller to perform the imbalance detection operation (step 84). This process may be repeated until the machine controller decides that the load imbalance in the drum is acceptable for the extraction operation.

In view of the many possible embodiments to which the principles of this invention may be applied, it should be recognized that the embodiment described herein with respect to the drawing Figures is meant to be illustrative only and should not be taken as limiting the scope of invention. Those of skill in the art will recognize that the elements of the illustrated embodiments can be modified in arrangement and detail without departing from the spirit of the invention. Therefore, the invention as described herein contemplates all such embodiments as may come within the scope of the following claims and equivalents thereof.

The invention claimed is:

1. A method of setting an extraction rotation speed for a drum in a laundry machine based on load imbalance detection, comprising:

rotating, by a motor controlled by a drive controller of the laundry machine, the drum with a laundry load therein at an imbalance detection speed;

detecting, by the drive controller, a variation amplitude of a phase angle between voltage and current applied to the motor;

characterizing, by the drive controller based on the detected phase angle variation amplitude, a detected load imbalance in the drum as being in one of a plurality of pre-defined load imbalance zones, each zone corresponding to a range of said amplitude;

transmitting, by the drive controller to a machine controller of the laundry machine, an imbalance indication signal to indicate the imbalance zone in which the detected load imbalance falls;

selecting, by the machine controller based on the imbalance indication signal, an extraction rotation speed for the drum for an extraction operation; and sending, by the machine controller, a control signal to the drive controller indicating the selected extraction rotation speed for the drum for the extraction operation, wherein the selected extraction rotation speed is the lesser of a speed associated with the indicated imbalance zone and a maximum speed for the type of laundry load.

2. A method as in claim 1, wherein the detection rotation speed is substantially lower than the extraction rotation speed.

3. A method as in claim 1, wherein the step of charactering includes retrieving from a memory of the drive controller a plurality of imbalance zone threshold levels defining the imbalance zones.

4. A method as in claim 1, wherein the imbalance zone threshold levels define three or more imbalance zones for characterizing the load imbalance in the drum.

5. A method as in claim 1, wherein the step of transmitting includes operating a signaling device to digitally transmit the imbalance indication signal to the machine controller.

6. A method as in claim 5, wherein the signaling device is a relay operated by the drive controller such that a time-dependent ON/OFF state of the relay indicates the imbalance zone corresponding the load imbalance in the drum.

7. A method as in claim 6, further including the step of displaying by the machine controller on a display panel the selected extraction rotation speed.

8. A method as in claim 2, further including the step of determining, based on the imbalance indication signal, whether to initiate a load redistribution operation to redistribute the laundry load in the drum.

9. A method as in claim 2, wherein each of the imbalance zones has a top speed associated therewith, and wherein the step of selecting the extraction rotation speed sets the extraction rotation speed to be equal to or less than the top speed associated with the imbalance zone indicated by the imbalance indication signal.

10. A control system for a laundry machine having a drum with a generally horizontal rotation axis for receiving a laundry load, comprising:

a drive controller for providing power to energize a motor for driving the drum into rotational motion; and a machine controller for controlling laundry operations of the laundry machine, the drive controller having a microprocessor and being programmed to detect a variation amplitude of a phase angle between current and voltage applied to the motor in an imbalance detection phase, characterize a load imbalance in the drum indicated by the detected phase angle variation amplitude as being in one of multiple pre-defined load imbalance zones, each zone corresponding to a range of said amplitude, and transmit an imbalance indication signal to the machine controller to indicate the imbalance zone for the detected load imbalance, the machine controller being programmed to receive the imbalance indication signal, select an extraction rotation speed for the drum, and transmit a command signal to the drive controller indicating the selected extraction rotation speed, wherein the drive controller controls the motor to rotate the drum at the selected extraction rotation speed during an extraction operation, and wherein the selected extraction rotation speed is the lesser of a speed associated with the indicated imbalance zone and a maximum speed for the type of laundry load.

11. A control system as in claim 10, wherein the imbalance detection phase in which the drum is rotated at a detection rotation speed lower than the selected extraction rotation speed.

12. A control system as in claim 10, wherein the drive controller has a memory storing a plurality of imbalance zone threshold levels defining the imbalance zones.

13. A control system as in claim 10, wherein the imbalance zone threshold levels define three or more imbalance zones for characterizing the load imbalance in the drum.

14. A control system as in claim 10, wherein the drive controller includes a signaling device for digitally transmitting the imbalance indication signal to the machine controller.

15. A control system as in claim 14, wherein the signaling device is a relay operated by the drive controller such that a time-dependent ON/OFF state of the relay indicates the imbalance zone characterizing the load imbalance in the drum.

16. A control system as in claim 15, wherein the machine controller includes a control panel, and the machine controller is programmed to display the selected extraction rotation speed on the control panel.

17. A control system as in claim 10, wherein the machine controller is programmed to initiate a load redistribution operation to redistribute the laundry load in the drum based on the imbalance indication signal.

18. A control system as in claim 10, wherein each of the imbalance zones has a top speed associated therewith, and wherein the machine controller is programmed to select an extraction rotation speed that is equal to or less than the top speed associated with the imbalance zone indicated by the imbalance indication signal.

* * * * *